US010054365B2

(12) United States Patent
Sonntag et al.

(10) Patent No.: US 10,054,365 B2
(45) Date of Patent: Aug. 21, 2018

(54) SAGGAR ASSEMBLY

(71) Applicant: IMERYS KILN FURNITURE HUNGARY, Hodmezovasarhely (HU)

(72) Inventors: Andreas Sonntag, Wasserburg am Inn (DE); Sandor Kiss, Hodmezovasarhely (HU)

(73) Assignee: Imerys Kiln Furniture Hungary, Hódmezövásárhely (HU)

( * ) Notice: Subject to any disclaimer, the term of this patent is extended or adjusted under 35 U.S.C. 154(b) by 281 days.

(21) Appl. No.: 14/631,104

(22) Filed: Feb. 25, 2015

(65) Prior Publication Data

US 2015/0241126 A1 Aug. 27, 2015

(30) Foreign Application Priority Data

Feb. 25, 2014 (DE) ..... 20 2014 100 849 U

(51) Int. Cl.
*F27D 5/00* (2006.01)
*F27D 3/00* (2006.01)

(52) U.S. Cl.
CPC ..... *F27D 5/0012* (2013.01); *F27D 3/0021* (2013.01); *F27D 5/0068* (2013.01)

(58) Field of Classification Search
CPC ..... F27D 3/0021; F27D 5/0012; F27D 5/0068
See application file for complete search history.

(56) References Cited

U.S. PATENT DOCUMENTS 1,186,490 A * 6/1916 Moorcroft ..... F27D 5/0006 432/258
1,336,762 A * 4/1920 Swinnerton ..... F27D 5/0012 432/258
1,502,973 A * 7/1924 Armstrong ..... C21D 9/0025 220/683
1,677,452 A * 7/1928 Jeffery ..... C04B 41/009 264/DIG. 57
1,832,442 A * 11/1931 Anderson ..... F27D 5/0012 432/258
2,297,286 A * 9/1942 Book ..... F27D 5/0012 432/258
3,109,420 A * 11/1963 Ott ..... F24C 1/16 126/9 R
3,498,597 A * 3/1970 Roberts ..... C21D 9/0025 220/4.01

(Continued)

*Primary Examiner* — Nathaniel Herzfeld
(74) *Attorney, Agent, or Firm* — Finnegan, Henderson, Farabow, Garrett & Dunner LLP

(57) ABSTRACT

An assembly for providing a saggar for use in high temperature applications, may include a rectangular base element and first and second sets of two rectangular wall elements, wherein the rectangular base element includes connectors on two opposite sides for connecting with the two rectangular wall elements of the first set of the rectangular wall elements at the two opposite sides. The two rectangular wall elements of the first set may each include a connector at a first edge for connecting with the rectangular base element at the two opposite sides, and the two rectangular wall elements of the first set each may include two recesses in a second edge opposite to the first edge and in the vicinity of each end of the second edge of the rectangular wall elements of the first set. The two rectangular wall elements may each include two ears for connecting with the recesses.

18 Claims, 2 Drawing Sheets

(56) References Cited

U.S. PATENT DOCUMENTS 4,184,841 A * 1/1980 Robinson ..... F27D 5/0025
432/258
6,795,016 B2 * 9/2004 Akiyama ..... B23K 37/0443
432/253

* cited by examiner

SAGGAR ASSEMBLY

CLAIM FOR PRIORITY

This application is a U.S. non-provisional application, which claims the benefit of priority of German Patent Application No. DE 20 2014 100 849.7, filed Feb. 25, 2014, the subject matter of which is incorporated herein by reference.

FIELD OF THE INVENTION

The invention concerns assemblies for assembling saggars for use in high temperature treatment, for example, the firing of ceramics, metal, powder calcinations or isolation foam manufacturing.

BACKGROUND OF THE INVENTION

Saggars are ceramic, box-like containers used in the firing of pottery to enclose or protect ware in kilns, or in powder calcinations for holding a powder to be calcined, or in isolation foam manufacturing for carrying the load, or in metal heat treatment. Traditionally, saggars were made primarily from fireclay. Saggars are used to protect or safeguard their load from open flame, smoke, gases and kiln debris. Modern saggars are made of various types of tailored ceramics such as for example alumina ceramics, cordierite ceramics, mullite ceramics, zirconia ceramics, magnesia ceramics, alumina-magnesia spinel ceramics, fused silica ceramics, aluminatitanate ceramics and silicon carbide ceramics.

Traditionally, saggars in commercial use used to comprise rigid rectangular boxes of unitary construction with an open top for receiving green ceramic articles placed therein for subsequent firing. Such saggars were adapted for storing vertically in the kiln for firing. Conventional saggars have a tendency to expand and contract as they are subjected to extreme temperature variations, and they often change shape, making them difficult to stack, or they may even break. It is not economically feasible to repair such saggars.

In many cases, saggars are used in heat treatments involving very rapid heating and cooling, such that high temperature gradients may appear within the saggars, leading to cracking. In the case of box-shaped solids in general, this implies a practicable upper size limit, while larger saggar sizes would be required. Furthermore, corrosion resistance at extreme temperatures is a general problem with saggars.

U.S. Pat. No. 4,008,997 discloses ceramic saggars composed of a square floor section and four identical wall sections, wherein the wall sections each comprise a flange at one end and a flange-receiving socket at an opposite end, as well as a floor supporting flange. The wall sections are assembled in positive locking engagement such that they form a square based volume and the floor section is lowered into the base of the said square. Since the base plate merely rests on the said floor supporting flanges, the assembled saggar is unstable. Furthermore, the appearance of gaps between the base and wall sections is inevitable, making this unsuitable for particulate loads, for example in powder calcinations. Despite the optional presence of gaps between the said flanges and flange-receiving sockets, which are intended to avoid the formation of thermal stresses, this does not solve the problem of upper size limits for the saggars.

The state of the art therefore constitutes a problem.

SHORT DESCRIPTION OF THE INVENTION

The above mentioned drawbacks are overcome by the invention according to the appended claims.

In one embodiment, the invention provides an assembly for providing a saggar, for use in high temperature applications, comprising a rectangular base element and first and second sets of two rectangular wall elements. According to the invention, the rectangular base element comprises connectors on two opposite sides for connecting with the two rectangular wall elements of the first set of rectangular wall elements at the said two opposite sides. The two rectangular wall elements of the first set each comprise a connector at first edges for connecting with the rectangular base element at its said two opposite sides, and the two rectangular wall elements of the first set each comprise two recesses in a second edge opposite the first edge and in the vicinity of each end of the second edge of the rectangular wall elements of the first set. The two rectangular wall elements of the second set each comprise two ears protruding from two adjacent corners of the rectangular wall elements for connecting with the said recesses of the rectangular wall elements of the first set. In an assembled state, the assembly according to the present invention provides a box-shaped saggar, which is open at the top and wherein the rectangular base portion forms the base and the rectangular wall sections form the outer walls.

In one embodiment, the two rectangular wall elements of the first set, together with their said connectors, have an essentially L-shaped cross-section. This shape provides added stability to the saggar in its assembled state.

In one embodiment, the connectors of the rectangular base and the two rectangular wall elements of the first set are longitudinal connectors extending along the respective sides of the base and edges of the wall elements, and the connectors are cooperating connectors for forming a positive locking engagement in an assembled state. The cooperating connectors may be designed for leaving a gap when forming a positive locking engagement, which can be filled with ceramic glue. Such connectors and ceramic glue provide improved stability to the saggar in its assembled state.

In one embodiment, the recesses of the two rectangular wall elements of the first set and the ears of the said two rectangular wall elements of the second set are shaped for forming a positive locking engagement in an assembled state. In order for this to happen, the recesses must be in such a position in the vicinity of the ends of the edges of their wall elements, such that in an assembled state the ears protruding from two adjacent corners of the rectangular wall elements of the second set reach into the recesses of the first set.

In one embodiment, the rectangular base and the two rectangular portions of the said sets comprise pinholes, and the assembly further comprises ceramic pins. The pinholes in the base section and the wall portions of the first set are located such that the rectangular wall portions of the second set may be secured to the rectangular base and the two rectangular portions of the first set in an assembled state with the help of the said ceramic pins. This improves stability and corrosion resistance of the saggar in an assembled state.

In one embodiment, the two rectangular portions of the first set comprise a longitudinal extension at their first edges, opposite the connectors and parallel to the rectangular base portion in the assembled state. These extensions in the assembled state serve as spacers from neighbouring saggars in use, for example when travelling on rollers through a rolling kiln, and protect the assembled saggars from physical damage in case of collisions.

In one embodiment, any one or more of the rectangular base and the rectangular wall elements may be made up of several sub-portions, which in an assembled state are connected through sub-connectors. The sub-connectors may be cooperating connectors for forming a positive locking engagement in an assembled state, similar to the connectors between the rectangular base portion and the rectangular wall elements of the first set. This improves thermal resistance in an assembled state.

In one embodiment, the rectangular base, and/or the rectangular wall elements may be made of hollow extruded parts, or solid parts, or a combination thereof. Hollow extruded parts have the advantage of being lighter and hence having reduced thermal capacity and resistance against thermal shock, whereas solid parts have improved physical stability and corrosion resistance.

In one embodiment, the elements of the assembly may be made of silicon carbide, silicon nitride, cordierite, alumina, alumina-magnesia spinell, magnesia, zirconia, zirconiasilicate, aluminasilicates, aluminatitanates, fused silica, or mixtures or combinations thereof.

Also part of the present invention is a saggar assembled from the assembly according to the present invention. The saggars according to the invention may be stackable and any intersections between the elements of the assembly may be filled with a sealant, such as for example a ceramic glue.

SHORT DESCRIPTION OF THE FIGURES

The invention is now being described in detail by illustration of embodiments thereof and with reference to the appended figures.

DETAILED DESCRIPTION OF THE INVENTION

Figure 1:
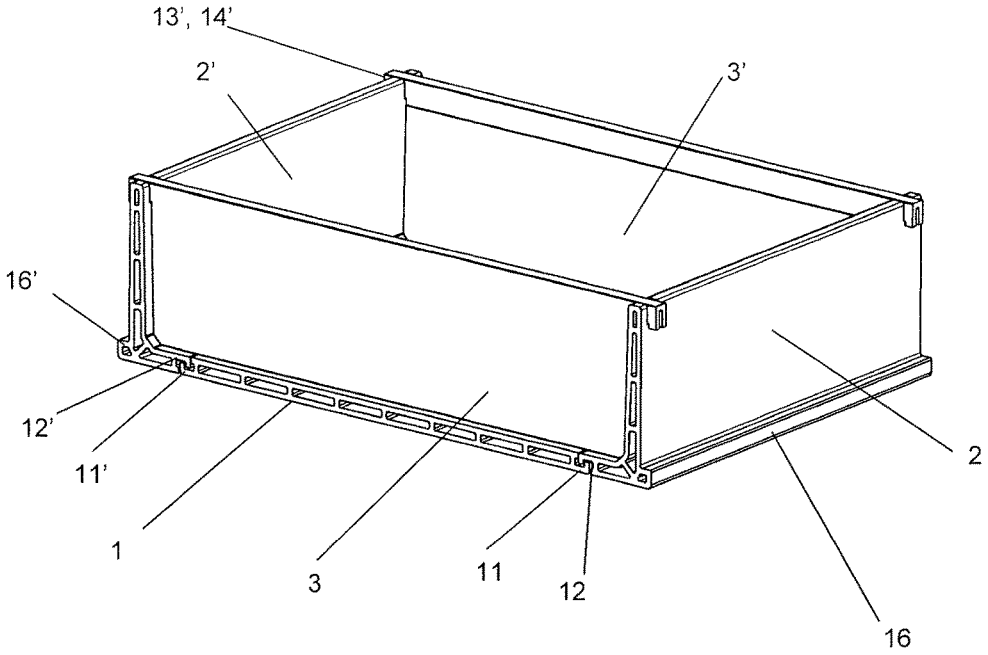
FIG. 1 shows a schematic representation of an assembly according to the present invention in the assembled state.

FIG. 1 shows a box-shaped saggar according to the present invention, as assembled from an assembly according to the present invention. As can be seen, the rectangular base element 1 and the rectangular wall elements of the first set 2, 2' are connected through cooperating longitudinal connectors 11, 11', 12, 12' on opposite sides of the rectangular base element 1 and one edge of each of the rectangular wall elements of the first set 2, 2'. Longitudinal extensions 16, 16' for protecting as spacers from neighbouring saggars in use is also shown. This is shown in better detail in FIG. 2 As shown in FIG. 3, the rectangular wall elements of the second set 3, 3' are connected to the rectangular wall elements of the first set 2, 2' through ears 13, 13' and recesses 14, 14'.

It has been found that with the assembly according to the present invention, saggar boxes having larger sizes can be obtained, without the known problems of formation of cracks or even breaking of the saggar during use, caused by thermal shock. The reason for this appears to be that the parts of the saggar in an assembled state are connected in a loose or flexible fashion, which ensures the free thermal expansion of the parts and avoids occurrence of high internal stresses. According to the present invention, box-shaped saggars having a size of up to 1000 mm×800 mm×200 mm may be obtained, which have improved thermal resistance and therefore durability during use.

The rectangular base element 1 as described herein may have a rectangular or square shape. The size of the rectangular base element may vary but needs to be adapted to the dimensions of the rectangular wall elements 2, 2', 3, 3' in the assembly. For example, the size of the rectangular base element may be about 600 mm×600 mm, or about 800 mm×600 mm, and up to about 1000 mm×800 mm.

The rectangular wall elements of the first set 2, 2' as described herein have an essentially rectangular shape. It should be noted however that in combination with a connector 12, 12' extending at a right angle in a longitudinal direction from one of its edges, each rectangular wall element of the first set 2, 2' will have a substantially L-shaped cross section. The wall formed by the said rectangular wall elements of the first 2, 2' set will be a rectangular wall in an assembled state. The size of the rectangular walls formed by the rectangular wall elements of the first set 2, 2' in an assembled state may vary but needs to be adapted to the size of the rectangular base 1 and the rectangular wall elements of the second set 3, 3'. For example the size may be about 600 mm×150 mm or about 600 mm×200 mm or about 800 mm×200 mm or up to about 1000 mm×200 mm.

The rectangular wall elements of the second set 3, 3' as described herein have an essentially rectangular shape. The size of the rectangular walls formed by the rectangular wall elements of the second set 3, 3' in an assembled state may vary but needs to be adapted to the size of the rectangular base and the rectangular wall elements of the first set 2, 2'. For example the size may be about 600 mm×150 mm or about 600 mm×200 mm or about 800 mm×200 mm or up to about 1000 mm×200 mm.

According to the present invention, the connectors 11, 11', 12, 12' between the rectangular base element 1 and the rectangular wall elements of the first set 2, 2' may be overlapping portions located longitudinally along the side of the rectangular base portion 1 and one edge respectively of the rectangular wall elements of the first set 2, 2'. The said overlapping portions may be shaped such that they can interlock by cooperating in order to form a positive locking engagement in an assembled state. The connection may be a sliding connection. It has been found that such a connection leaves sufficient flexibility between the different elements in order to avoid thermal shock, while at the same time providing good physical stability of the box-shaped saggar in an assembled state. This is shown in FIG. 2.

The gap between the cooperating elements may be filled with a sealing composition, such as a ceramic glue. This improves the sealing properties of the assembled saggar, which is particularly relevant in the case of particulate loadings, for example for powder calcinations, while at the same time in case of thermal stress, any damage occurring, if at all, will be limited to the sealant, rather than the structural elements of the saggar.

As can be seen in FIGS. 1 and 3, the ears 13, 13' and recesses 14, 14' respectively of the rectangular wall elements 2, 2', 3, 3' of the first and second sets are located such that they interconnect in the assembled state of the assembly when forming a box-shaped saggar. The ears 13, 13' are positioned such that they extend beyond the edge of the rectangular wall elements 3, 3' of the second set to such an extent that the can reach into the corresponding recesses 14, 14' of the rectangular wall elements 2, 2' of the first set that a positive locking engagement is achieved in an assembled state. The positions and sizes of the ears and recesses are adapted accordingly. It has been found that this particular arrangement minimises thermal stress during use while at the same time providing good physical stability of the box-shaped saggar in the assembled state.

Figure 2:
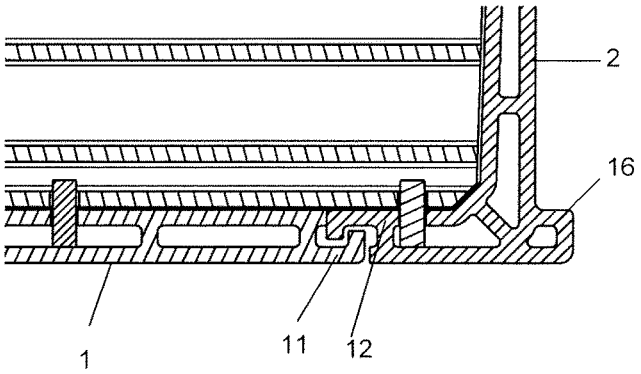
FIG. 2 shows a schematic representation of a cut through a portion of a box-shaped saggar assembled from an assembly according to the present invention.
Figure 3:
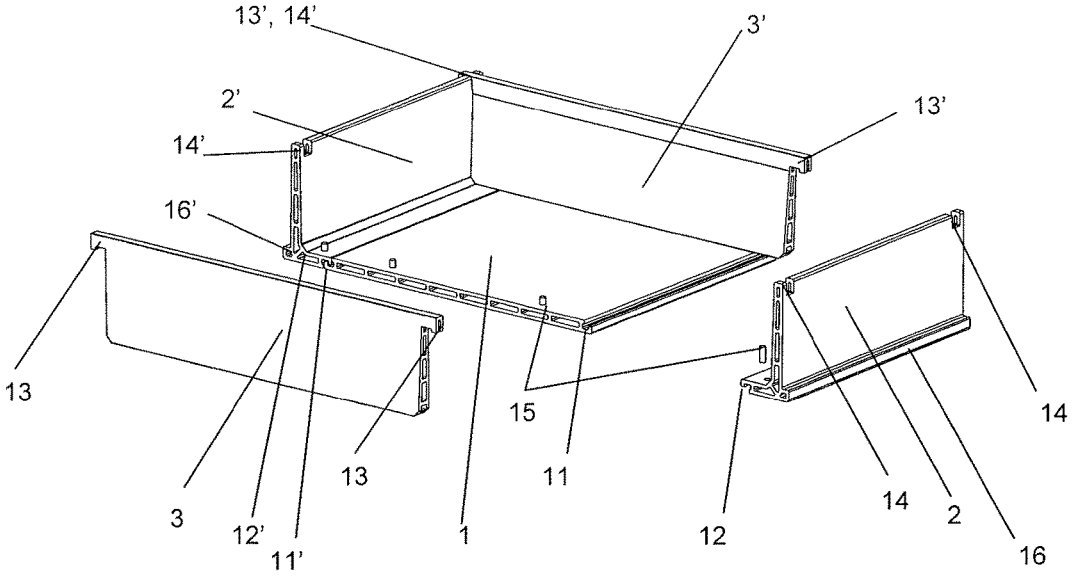
FIG. 3 shows a schematic representation of an assembly according to the present invention in a partially assembled state.

As shown in FIGS. 2 and 3, the rectangular wall elements of the first set 2, 2' and the rectangular base element 1 may further comprise pinholes for securing the rectangular wall elements of the second set thereto through ceramic pins 15, 15'. The said pinholes are located in the said elements along the lines on which the rectangular wall elements of the second set 3, 3' are intended to be positioned in an assembled state to form a box-shaped saggar. In particular, the pinholes may be placed at regular intervals along these lines, including as close to the rectangular wall formed by the rectangular wall element of the first set as practically possible. When assembled with pins in the pinholes accordingly, improved stability of the assembled box-shaped saggar is obtained, and additional flexibility is created at the interfaces of the pins and pinholes to reduce thermal stresses. Gaps between the pinholes and the pins may be filled with a sealing composition, such as a ceramic glue. This further improves the sealing properties of the assembled saggar, which is particularly relevant in the case of particulate loadings, for example for powder calcinations, while at the same time, in case of thermal stress, any damage occurring will be limited to the sealant, rather than the structural elements of the saggar.

According to the present invention, the different elements of the assembly may be made of suitable materials known to the skilled person, such as silicon carbide, silicon nitride, cordierite, alumina, alumina-magnesia spinell, magnsesia, zirconia, zirconsilicate, aluminasilicates, aluminatitante, fused silica, or mixtures thereof. Different elements in the assembly may be made of different materials, such as to obtain a combination of materials. The materials may be selected on the basis of the specific requirements, such as intended thermal profile, maximum temperature, load mass, load materials, or load consistency, such as solid or particulate. According to the present invention, the materials of the elements of the assembly may be further coated with a corrosion resistant material, in order to improve corrosion resistance during use.

Figure 4:
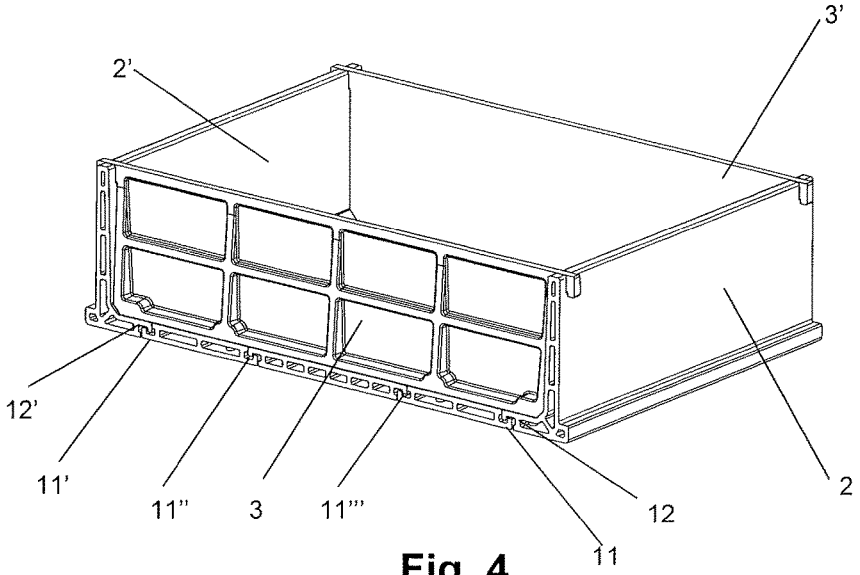
FIG. 4 shows a schematic representation of an assembly according to the present invention, wherein the rectangular base section is composed of three sub-portions connected through sub-connectors.

As can be seen from FIG. 4, the base element may be formed of various sub-portions 1', 1", 1'", connected together in an assembled state through connectors 11", 11'". These connectors may be similar or identical in structure to the connectors between the base element 1 and the wall elements of the first set 2, 2'. The same can be done to the wall elements of the first and/or second sets 2, 2', 3, 3'. This is particularly useful in the case of large elements, as it improves thermal resistance of the elements and therefore increases durability of the assembled saggar. In this case also, the gaps between the connectors formed may be filled with a sealant, such as ceramic glue.

According to the present invention, the various elements of the assembly may either be hollow extruded elements or solid (full) elements. A combination of hollow and solid elements may be used as well. Solid elements tend to have improved physical stability, while hollow elements tend to have improved thermal stability. For example in the case of heavy load requirements, it can be advantageous to employ solid base elements, in order to improve its strength. For materials that require rapid heating and cooling, hollow elements may be advantageous.

It should be noted that the present disclosure includes any combination of the features and/or limitations referred to herein, except for combinations of such features which are mutually exclusive. The foregoing description is directed to particular embodiments of the present invention for the purpose of illustrating it. It will be apparent, however, to one skilled in the art, that many modifications and variations to the embodiments described herein are possible. All such modifications and variations are intended to be within the scope of the present invention, as defined in the appended claims.

REFERENCE SIGNS

1, 1', 1", 1'" rectangular base element;
2, 2' rectangular wall elements of the first set;
3, 3' rectangular wall elements of the second set;
11, 11', 11", 11'" longitudinal connectors of the rectangular base element;
12, 12' longitudinal connectors of the rectangular wall elements of the first set;
13, 13' ears of the rectangular wall elements of the second set;
14, 14' recesses of the rectangular wall elements of the first set;
15 ceramic pins;
16, 16' longitudinal extensions.

The invention claimed is:

1. An assembly for a saggar for use in high temperature applications, the assembly comprising:
- a rectangular base element comprising connectors along two opposite sides of the rectangular base element;
- a first set of two rectangular wall elements; and
- a second set of two rectangular wall elements;
- wherein each rectangular wall element of the first set comprises:
  - a connector extending away from and substantially perpendicular to a first edge of the rectangular wall element, the connector and rectangular wall element forming a substantially L-shaped cross section and
  - two recesses in a second edge opposite to the first edge,
- wherein the connectors of the rectangular base element are configured to form a positive locking connection with distal ends of the connectors of the rectangular wall elements of the first set in a longitudinal direction of the rectangular base element; and
- wherein each rectangular wall element of the second set comprises two ears for connecting with the recesses of the rectangular wall elements of the first set.

2. The assembly according to claim 1, wherein in an assembled state, the saggar is a box-shaped saggar, and the ears of the rectangular wall elements of the second set protrude from adjacent corners of the box-shaped saggar.

3. The assembly according to claim 1, wherein the connectors of the rectangular base element are configured to leave gaps relative to the connectors of the rectangular wall elements of the first set when forming the positive locking connection.

4. The assembly according to claim 1, wherein the recesses of the two rectangular wall elements of the first set and the ears of the two rectangular wall elements of the second set are configured to form a positive locking engagement in an assembled state.

5. The assembly according to claim 1, wherein the rectangular base element and the two rectangular wall elements of the first set and the two rectangular wall elements of the second sets comprise pinholes, and the assembly further comprises ceramic pins that secure the two rectangular wall elements of the second set to the rectangular base element and to the two rectangular wall elements of the first set in an assembled state via the pinholes.

6. The assembly according to claim 5, wherein the rectangular base element and the rectangular wall elements of the first and second sets are made of a corrosion resistant material.

7. The assembly according to claim 1, wherein each rectangular wall element of the first set comprises a longitudinal extension at the first edge, opposite the connector of the rectangular wall element and parallel to the rectangular base element in an assembled state.

8. The assembly according to claim 1, wherein one or more of the rectangular base element and the rectangular wall elements are formed from several sub-portions, which in an assembled state are connected via sub-connectors.

9. The assembly according to claim 1, wherein the sub-connectors are cooperating connectors for forming a positive locking engagement in an assembled state.

10. The assembly according to claim 1, wherein the rectangular base element and the rectangular wall elements of the first and second sets are each hollow, solid, or a combination thereof.

11. The assembly according to claim 1, wherein the rectangular base element and the rectangular wall elements are made of silicon carbide, silicon nitride, cordierite, alumina, alumina-magnesia spinell, magnesia, zirconia, zirconiasilicate, aluminasilicates, aluminatitanates, fused silica, or mixtures or combinations thereof.

12. A saggar for use in high temperature applications comprising the assembly of claim 1.

13. The saggar according to claim 12, wherein gaps between the rectangular base element, the rectangular wall elements of the first set, and the rectangular wall elements of the second set are filled with a sealant.

14. The assembly according to claim 5, wherein each rectangular wall element of the first set includes a pinhole adjacent to the connector and aligned with a corresponding pinhole in one of the rectangular wall elements of the second set in the assembled state.

15. The saggar according to claim 13, wherein gaps between the connectors of the rectangular base element and the connectors of the rectangular wall elements of the first set are filled with ceramic glue.

16. The saggar according to claim 1, wherein the rectangular base element comprises pinholes along edges of the rectangular base element between the two opposite sides, the pinholes of the rectangular base element being aligned with corresponding pinholes of the rectangular wall elements of the second set in an assembled state.

17. An assembly for a saggar, the assembly comprising:

a base element comprising two connectors at opposite sides of the base element;

two first wall elements, each first wall element comprising a connector extending from a first edge of the first wall element, at least one pinhole between the first edge and the connector of the first wall element, and two recesses in a second edge opposite the first edge; and two second wall elements, each second wall element comprising at least one pinhole and two ears for connecting with the recesses of one of the two first wall elements;

wherein, in an assembled state, the connectors of the base element engage distal ends of the connectors of the first wall elements in a locking connection along a plane that contains the base element, and each pinhole of the first wall elements is aligned with one of the pinholes of the second wall elements.

18. An assembly for a saggar, the assembly comprising:

a base element comprising two connectors at opposite sides of the base element and pinholes along edges of the base element between the opposite sides;

two first wall elements, each first wall element comprising a connector extending at a right angle from a first edge of the first wall element and at least one pinhole between the first edge and the connector; and two second wall elements, each second wall element comprising a plurality of pinholes;

wherein, in an assembled state, the connectors of the base element engage distal ends of the connectors of the first wall elements in a locking connection along a plane that contains the base element, and each pinhole of the second wall elements is aligned with one of the pinholes of the base element or one of the pinholes of the first wall elements.

* * * * *